US009863165B1

(12) United States Patent
Hongthong

(10) Patent No.: US 9,863,165 B1
(45) Date of Patent: Jan. 9, 2018

(54) STANCHION OR POST WITH INTERNAL WEIGHTED BASE AND SPRING-LOADED RETRACTABLE LEGS

(71) Applicant: Thanomsak Hongthong, Middle Island, NY (US)

(72) Inventor: Thanomsak Hongthong, Middle Island, NY (US)

( * ) Notice: Subject to any disclaimer, the term of this patent is extended or adjusted under 35 U.S.C. 154(b) by 0 days.

(21) Appl. No.: 15/359,938

(22) Filed: Nov. 23, 2016

(51) Int. Cl.
*E04H 17/20* (2006.01)
*E04H 17/24* (2006.01)
*E01F 13/02* (2006.01)

(52) U.S. Cl.
CPC ..... *E04H 17/20* (2013.01); *E01F 13/022* (2013.01); *E01F 13/028* (2013.01); *E04H 17/24* (2013.01)

(58) Field of Classification Search
CPC ..... E04H 17/20; E04H 17/22; E04H 17/24; E04H 17/08; E04F 11/1812; E01F 13/02; E01F 9/677; E01F 9/692; E01F 9/70
See application file for complete search history.

(56) References Cited

U.S. PATENT DOCUMENTS 377,337 A * 1/1888 Tourgee ..... E04H 17/20 174/7
1,582,454 A * 4/1926 Evans ..... E04H 17/08 52/155
2,392,011 A * 1/1946 Freeman ..... E01F 13/02 182/181.1
4,817,318 A 4/1989 Strauch
5,979,844 A * 11/1999 Hopkins ..... E01F 13/02 248/158
7,628,373 B2 * 12/2009 Kokenes ..... G09F 7/18 248/534
7,669,815 B2 * 3/2010 Clewett ..... E01F 9/692 248/163.1
8,146,871 B1 * 4/2012 Kulp ..... G09F 15/0062 248/168
2012/0192468 A1 * 8/2012 Brown ..... G09F 15/0062 40/542

FOREIGN PATENT DOCUMENTS

CA 2360739 A1 * 4/2003 ..... E04C 3/36
CA 2560326 A1 * 9/2005 ..... E04H 12/2238
CH 700853 A1 * 10/2010 ..... E01F 13/02

* cited by examiner

*Primary Examiner* — Jonathan Masinick

(57) ABSTRACT

A post including a cylindrical weighted base having at least three spring-loaded retractable legs. When the post is to be stored, the legs are pulled together and pushed inside the post via slotted openings at the base of the post. An adjustable position locking tab is used to secure the legs inside for storage and adjusted open for when the legs are to be deployed. In an alternative post, a threaded stake is included for anchoring the post into ground for outdoor applications such as construction sites.

1 Claim, 6 Drawing Sheets

STANCHION OR POST WITH INTERNAL WEIGHTED BASE AND SPRING-LOADED RETRACTABLE LEGS

FIELD OF THE INVENTION

The present invention relates to stanchions or posts used in both indoor and outdoor environments. More specifically, the present invention is a stanchion including an internal weighted base having spring-loaded retractable legs that are deployed when the stanchion is to be used and are retracted back inside the stanchion when the stanchion is in storage. The post could alternatively be used with an elongated threaded support rod for outdoor applications such as construction road signs where additional support is required to keep the post anchored into the ground.

BACKGROUND OF THE INVENTION

A stanchion is a sturdy upright post that provides support for various applications such as controlling the flow of people or construction related applications such as road signs. Typically these posts are of hollow tube construction so that the tops of the posts can be fitted with cassette belts, lanyards, ropes, chains or signs depending on the specific intended use of the post. Most indoor posts are mounted on a weighted base that typically consists of a disc shape weighing approximately fifteen pounds. Most outdoor posts are mounted on a tripod stand and can include a threaded center rod to anchor the post into the ground.

There are several problems with a post that is mounted on either a weighted base or a tripod stand. First, the weighted base or tripod stand is often a large diameter size such as between two and four feet, and therefore posts having weighted bases or stands take up a lot of space when they are in storage. Second, posts having either weighted bases or tripod stands tend to degrade quickly in their appearance by getting dinged or scratched from close contact with other posts while in storage in a closet, shelf or truck bed. Finally, since the weighted base or tripod stands are typically attached to the post itself using small threaded fasteners such as screws or locking pins, it is common for these threaded fasteners to become easily lost or damaged over time by dirt, debris or rust from environmental exposure at road construction sites.

What is desired, therefore, is a post which includes an internal weighted base with retractable legs that can be used in both indoor and outdoor applications. Such a post would be desirable because it would save space in storage and would allow the same number of posts to be stored in a closet or shelf instead of a larger storage room. Such a post would also be desirable because it would easy to deploy the legs by simply sliding a locking tab and allowing the legs to drop out the bottom through slots at the base of the post. Such a post would also be desirable when converted for storage by simply grabbing the legs together and pushing the post towards the ground to retract them inside the post.

SUMMARY OF THE INVENTION

It is a primary object of the present invention to provide a post that has an internally contained weighted base with at least three spring-loaded legs that extend outward once the legs have passed through corresponding slots cut into the base of the post.

A further object of the present invention to provide a securing mechanism at the base end of the post that prevents the weighted base legs from deploying by blocking the entrance of one of the slots at the base of the post.

An alternative embodiment of the present invention is to implement a threaded center rod attached to the internal weighted base which would pass through a clearance hole located at the base of the post. This alternative embodiment would provide additional support for posts used in outdoor applications by using the threaded center rod as a stake to be pushed into soft ground to anchor the post. A securing mechanism would prevent the threaded center rod and legs from deploying by blocking the entrance of the center clearance hole at the base of the post.

DETAILED DESCRIPTION OF THE INVENTION

Figure 1:
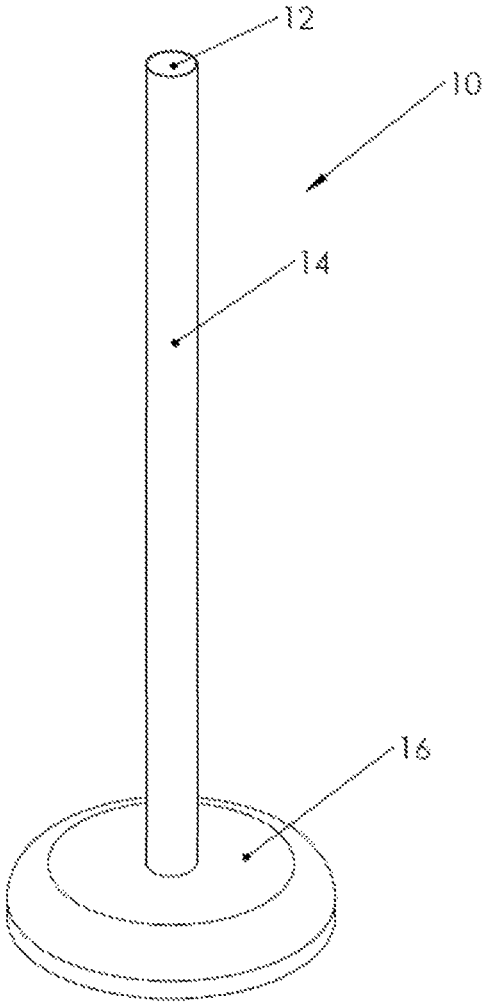
Fig. 1 PRIOR ART
FIG. 1 is a perspective view of a prior art stanchion.

FIG. 1 depicts an example of a prior art stanchion. In FIG. 1 a prior art stanchion 10 has a top opening 12 and a hollow main body tube post 14. A weighted base 16 is mounted to the base of the tube 14 using fasteners (not shown). Typically cassette belts, or posts with hooks for rope (not shown) are mounted to the top opening 12 of prior art post 10. The weighted base 16 typically weighs between 15 and 20 pounds in order to prevent the stanchion 10 from tipping over. Although not shown, a typical alternative prior art stanchion used in outdoor applications has a tripod stand mounted to the tube post 14 to give the stanchion additional support against being tipped over by strong wind gusts. An example of an alternative prior art stanchion using a tripod stand mount in lieu of a weighted base is U.S. Pat. No. 4,817,318 issued to Strauch entitled Demountable Road Sign.

Figure 2:
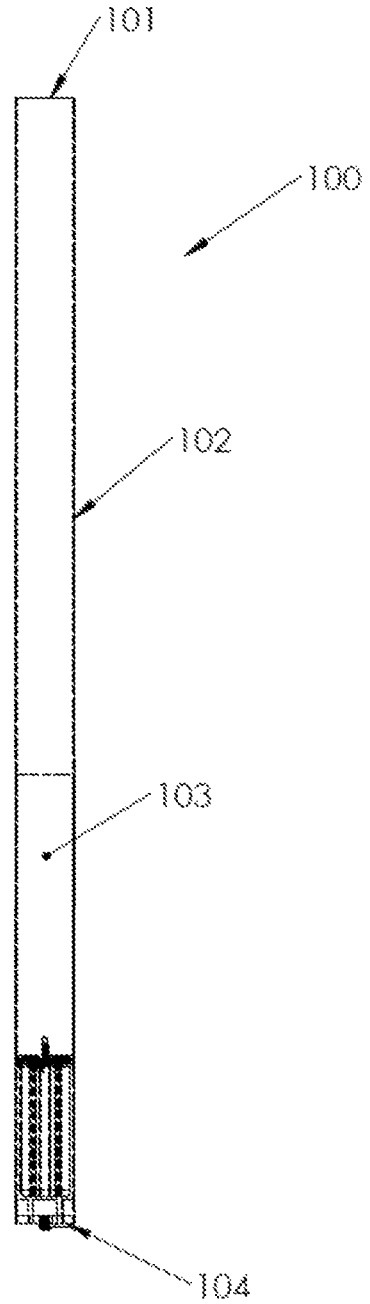
FIG. 2 is a perspective view of the post of the present invention shown in its retracted state for storage purposes.

FIG. 2 depicts the post of the present invention shown in a fully retracted state. The post 100 includes a hollow base tube 102, a top opening 101, a bottom plate 104 and a weighted base assembly 103. Similar to prior art posts, the top opening 101 is used to mount accessories to the stanchion (not shown) such as cassette belts or top caps having hooks for use with chains or ropes. The top opening 101 also is needed in order to drop in the retractable weighted base assembly 103 which under its own weight will drop down the hollow tube until the retracted legs of the weighted base assembly 103 come into contact with the bottom plate 104. In this fully retracted state, the post 100 can be stored bundled together with other posts 100 to save significant amounts of space over prior art posts with weighted bases such as was shown in FIG. 1 previously.

Figure 3:
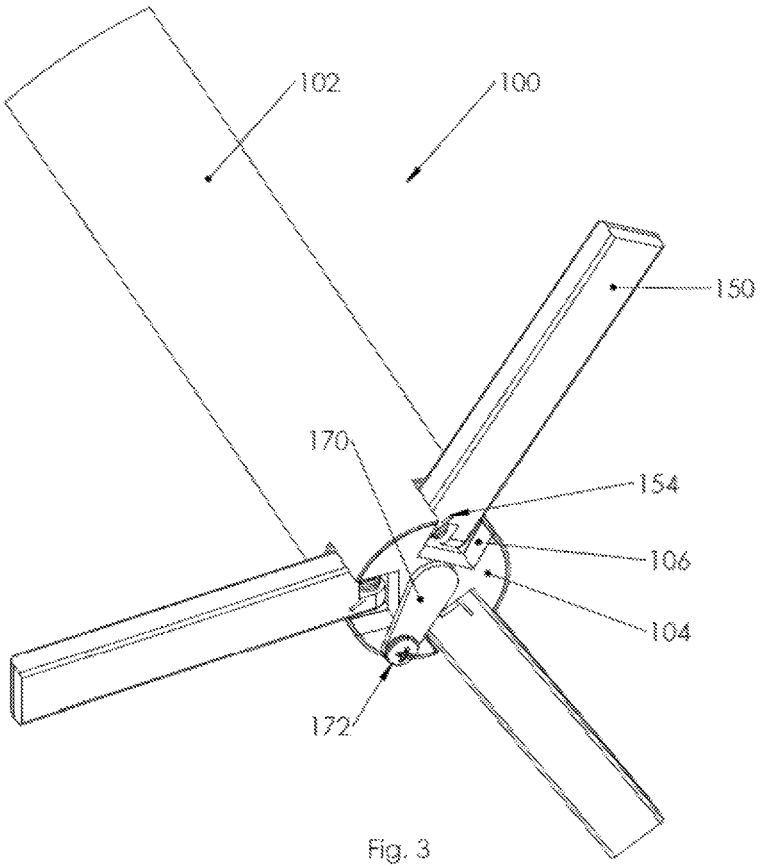
FIG. 3 is a detail view of the bottom end of the post showing the legs of the base in the extended position.

Referring next to FIG. 3, a close up view of the bottom end of post 100 is shown to depict the post in a normal state of usage where the legs are fully extended. In the primary embodiment shown, there are three legs 150 extended to provide a sturdy support stand, but four or more legs are also permissible in the present invention. The legs 150 are extended using torsion springs 154 which are located in the center slot cut at the distal end of each leg and held in place using a pin 152 (not shown). The bottom plate 104 also has at least three slots 106 which allow clearance for the three legs to pass through the bottom of the post base. When the post is to be used, the locking tab 170 is rotated towards the center of the post as shown which allows all three legs to pass through. The locking tab is held in place on the bottom plate 104 using a screw fastener 172. The weighted base 103 (not shown) remains inside the post tube 102 while the legs are retracted and represents approximately ten pounds of weight.

Figure 4:
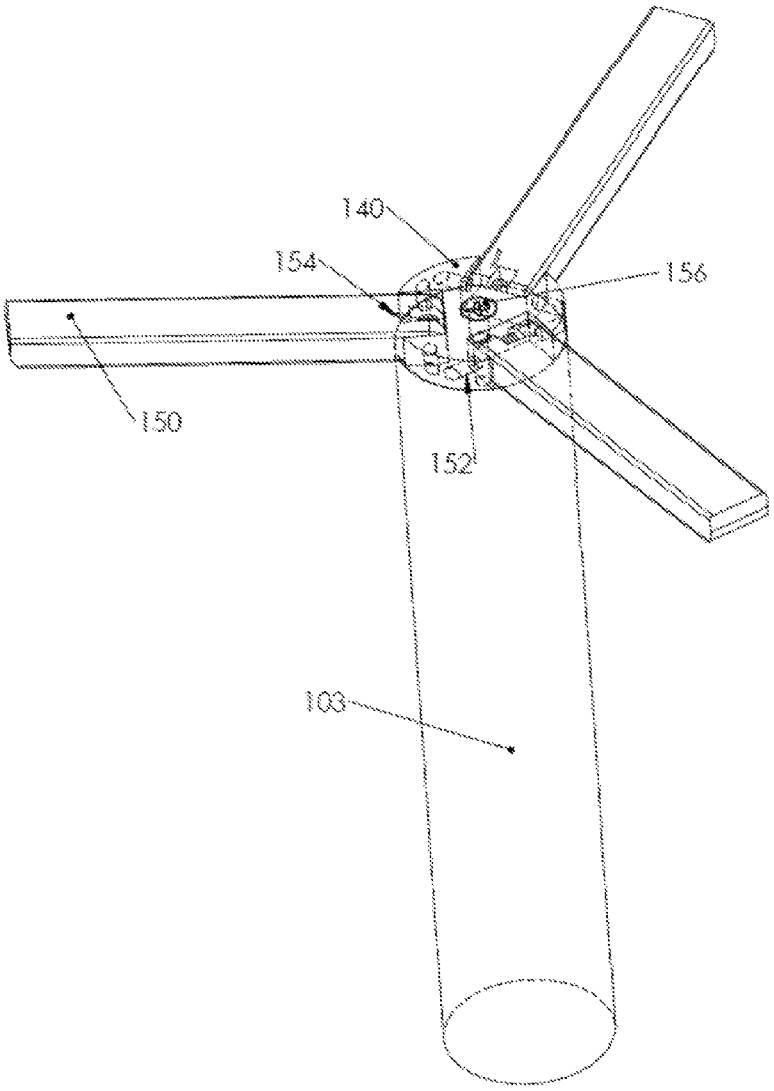
FIG. 4 is a perspective view of the internal weighted base assembly of the present invention to show the assembly details including the spring loaded mechanism to deploy the legs.

Referring next to FIG. 4, the internal weighted base assembly is next depicted. The weighted base 103 has a center tapped hole at its distal end to which is attached a slotted end cap 140 using a fastener screw 156. Each leg 150 is pinned in place using a pin 152 which is press fit through holes drilled into the slotted end cap 140. The torsion spring 154 is also concentrically mated to the pin and is held in place though centered slots cut into each leg as shown.

Figure 5:
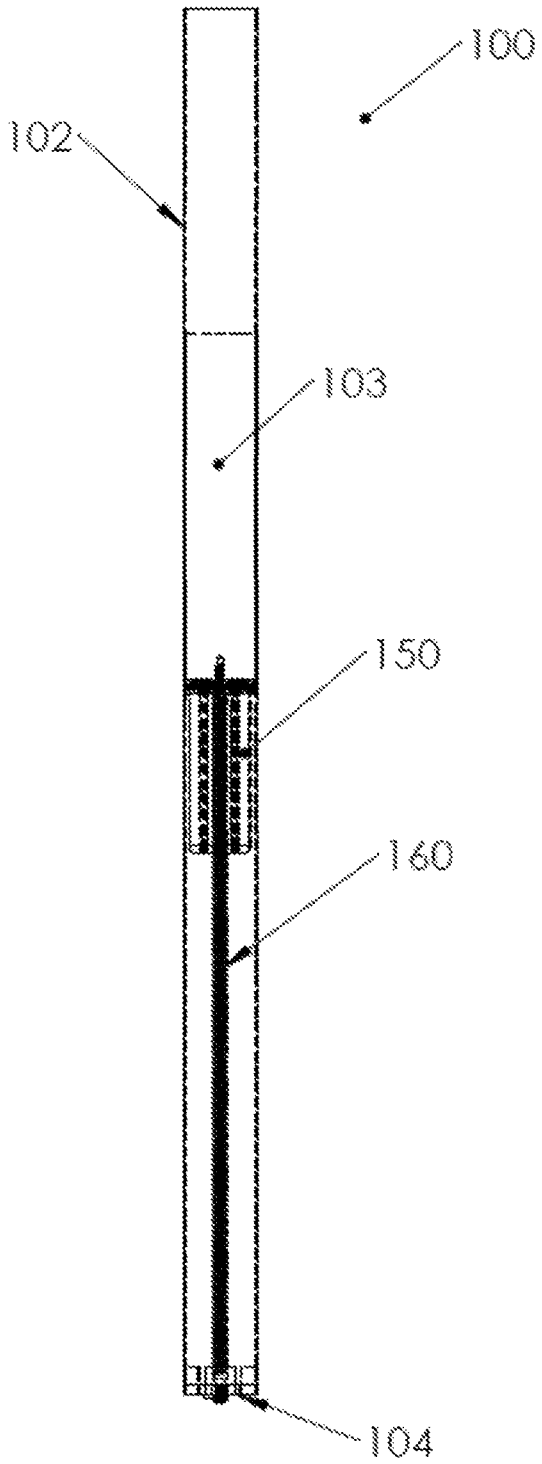
FIG. 5 is a perspective view of an alternative post shown in its retracted state for storage purposes.

Referring next to FIG. 5, an alternative embodiment of the post is depicted in its retracted state. In this alternative post 100, there is a long threaded rod stake 160 that is between 12 and 24 inches in length. The stake 160 is threaded and has a sharp point at its distal end in order to penetrate into soft ground in outdoor applications requiring extra support due to factors such as high wind gusts. The threaded stake 160 is rigidly mounted to the weighted base 103 using a corresponding tapped hole at the center of the weighted base. The retracted legs 150 remain folded against the inner wall of post tube 102. Although not shown, the threaded stake 160 is held in place using the locking tab 170 which would be rotated such that it covers the opening for the stake at the bottom plate 104.

Figure 6:
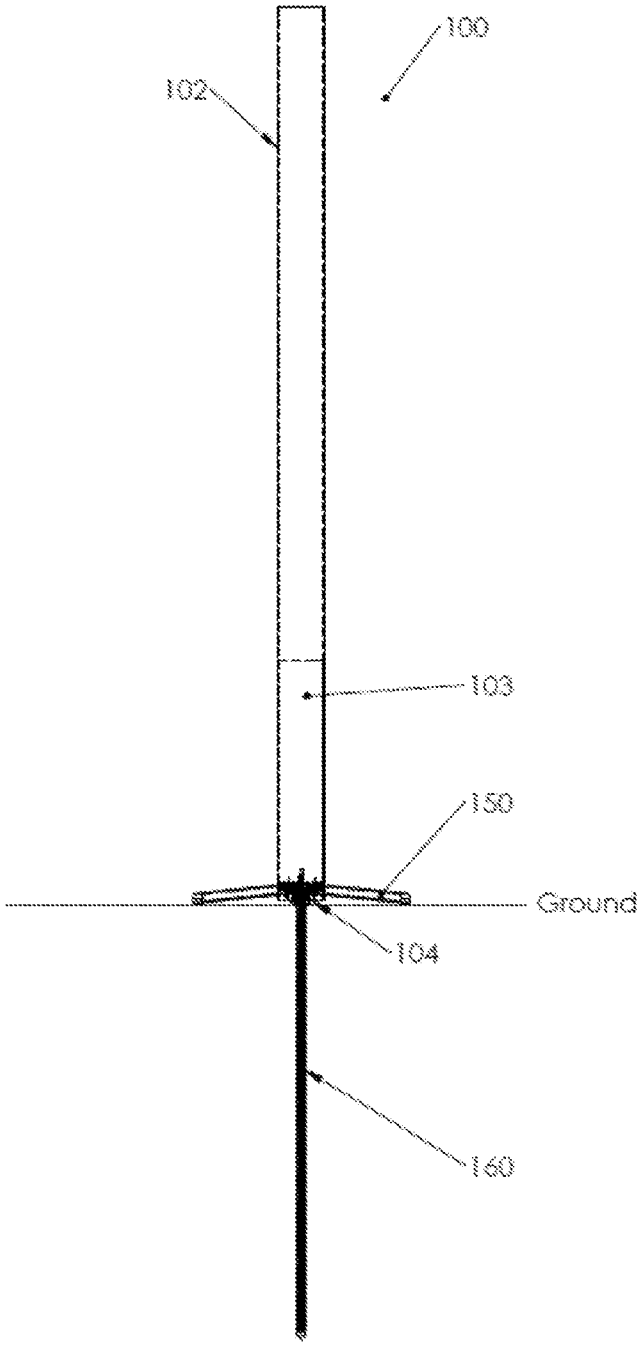
FIG. 6 is a perspective view of the alternative post shown with the legs and center threaded rod deployed for use.

Referring finally to FIG. 6, the alternative embodiment of the present invention is shown in its extended state in use. The locking tab 172 (not shown) is rotated away from both the leg slots on the bottom plate 104 and from the center opening so that the legs and threaded stake drop into place under gravity assisted by the weighted base 103. The legs are then deployed outward due to force exerted from the torsion springs 154 (not shown) and the threaded stake 160 is pushed into the ground to anchor the post 100. A construction sign (not shown) may then be attached to the top opening of the post tube 102.

What is claimed is:

1. A post assembly comprising:

A) a hollow metal cylindrical tube having an opening at both top and bottom ends with three equally spaced slotted apertures located at the bottom end;

B) a cylindrical weight with a threaded hole centered at the bottom end and moveably connected within the interior of said tube;

C) a weighted cylindrical cap having three radially equally spaced slotted apertures cut into a rim of said weighted cap; said weighted cap having three equally spaced alignment holes passing through the outer rim in a perpendicular orientation to said radially spaced apertures for use with alignment pins; said weighted cap having a countersunk threaded hole passing through its center for rigid attachment to said weight using a threaded fastener;

D) a set of three weighted elongated bars that are movably connected to said end cap; said bars each having a through hole passing through near one distal end that is concentrically aligned with said end cap side walls as well as a slotted aperture at the same distal end;

E) a set of three alignment pins that moveably connect said bars to said end cap by passing through both said concentrically aligned aperture side wall holes and said bar end holes;

F) a set of three torsion springs that are each concentrically aligned with said alignment pins and located inside said slotted apertures of said weighted bars; said springs providing force to move bars radially outward when said post is deployed for use;

G) a circular end plate that is rigidly attached to said tube at its bottom distal end and having three equally spaced slotted apertures that are aligned with said slotted apertures at the bottom distal end of said tube; said circular end plate having a threaded hole located between one pair of slotted apertures near the outer circumference; said circular end plate having a hole passing thru its center;

H) a finger-shaped tab that is movably connected to said circular end plate at one distal end having a hole allowing for attachment of said tab to said circular end plate using a threaded screw fastener; said tab having a radiused opposite end having a larger radius than said center hole of said circular end plate; and I) an elongated rod having a threaded portion at one distal end for the purpose of attachment to said weighted cylindrical cap and a pointed shape at the opposite end for the purpose of penetrating soil for use as a method of anchoring said post to the ground.

* * * * *